US006286476B1

(12) United States Patent
Hiraoka et al.

(10) Patent No.: US 6,286,476 B1
(45) Date of Patent: Sep. 11, 2001

(54) ENGINE LUBRICATING SYSTEM

(75) Inventors: Noriyoshi Hiraoka; Masanori Takahashi; Hiroshi Oishi, all of Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 279 days.

(21) Appl. No.: 08/842,088

(22) Filed: Apr. 28, 1997

(30) Foreign Application Priority Data

Apr. 30, 1996 (JP) ..... 8-130541
Apr. 30, 1996 (JP) ..... 8-130542

(51) Int. Cl.[7] ..... F01M 1/00
(52) U.S. Cl. ..... 123/196 W; 123/196 R
(58) Field of Search ..... 123/196 W, 196 R

(56) References Cited

U.S. PATENT DOCUMENTS 5,085,186 2/1992 Kobayashi .
5,456,230 * 10/1995 VanRens et al. ..... 123/196 W
5,460,555 10/1995 Fukuoka et al. .
5,524,581 * 6/1996 Rush, II et al. ..... 123/196 W
5,687,686 * 11/1997 Takahashi ..... 123/196 W
5,687,688 * 11/1997 Tsunoda et al. ..... 123/196 W
5,690,062 * 11/1997 Yamada ..... 123/196 AB

* cited by examiner

*Primary Examiner*—John Kwon
(74) *Attorney, Agent, or Firm*—Ernest A. Beutler

(57) ABSTRACT

A lubricating system is disclosed for an engine arranged such that the crankshaft is vertically oriented. The crankshaft rotates within a crankcase chamber defined by the cylinder block and a crankcase cover connected thereto. First crankshaft support members which support half-bearings extend from the cylinder block. Mating half-bearings are supported by second crankshaft support members positioned opposite the first crankshaft support members. A baffle plate is positioned in the crankcase chamber between the crankcase cover and the crankshaft. At least one oil flow passage is defined through the crankcase chamber from a top end to a bottom end of the chamber. In one embodiment, oil is supplied through a main passage in the crankcase cover and a branch passage through each second crankshaft support members for lubricating the bearings.

20 Claims, 11 Drawing Sheets

ENGINE LUBRICATING SYSTEM

FIELD OF THE INVENTION

The present invention relates to an internal combustion engine. More particularly, the invention is an improved lubricating system for an engine having a vertically arranged crankshaft.

BACKGROUND OF THE INVENTION

Internal combustion engines which are utilized to power outboard motors are commonly oriented vertically in a cowling of the motor. In this arrangement, each piston reciprocates along a horizontal axis. Each piston is connected, via a crankrod, to a vertically extending crankshaft. This crankshaft extends out the bottom of the engine in driving relation with a water propulsion device of the outboard motor.

This outboard motor engine arrangement has the advantage that the crankshaft is oriented for simple connection to a transmission or other drive for the water propulsion device. Several disadvantages are associated with this engine arrangement, however. One problem relates to the lubricating system.

As is well known, in these engines crank-bearing halves are connected to crankshaft supports extending from the cylinder block for rotatably supporting the crankshaft. Corresponding bearing halves are supported by a bearing cap connected to the cylinder block.

Oil is supplied by an oil pump from an oil pan to oil passages throughout the cylinder block of the engine. These passages include a main passage and several bearing passages leading through the crankshaft supports extending from the cylinder block for lubricating the crankshaft bearing areas. It is then intended for the lubricating oil to drain through the crankcase to the bottom of the crankcase for recovery and delivery back to the oil pan.

It has been found, however, that the lubricating oil largely becomes trapped in the bearing support areas of the bearing cap and adjacent crankcase cover. The total amount of oil available for distribution through the engine while it is running is reduced, and the oil within the crankcase may be foamed as it is thrown from the crankshaft, runs back towards the crankshaft, and is thrown from the crankshaft in repeating fashion.

In addition, the manner by which the lubricating oil is supplied to the bearing parts which support the crankshaft often greatly complicates the construction of the engine.

A lubricating system for an engine including a vertically arranged crankshaft, is desired.

SUMMARY OF THE INVENTION

In accordance with the present invention, there is provided a lubricating system for an engine arranged so that the crankshaft is vertically extending. At least a portion of the crankshaft is rotatably positioned within a crankcase chamber defined by a cylinder block of the engine and a crankcase cover connected thereto. The crankshaft is supported within the crankcase chamber by at least one first crankshaft supporting member which extends from the cylinder block and at least one corresponding second crankshaft supporting member positioned on the opposite side of the crankshaft.

Preferably, an oil flow passage or path is provided through the crankcase chamber from a top end to a bottom end thereof. In this manner, lubricating oil which is delivered to the crankcase chamber and dispersed therein easily drains to the bottom of the crankcase chamber for return to an oil reservoir for redistribution throughout the engine.

In accordance with a first embodiment of the present invention, at least one second crankshaft supporting member extends from the crankcase cover. Oil is supplied from an oil reservoir by a pump to a main gallery or passage in the crankcase cover. Branch passages lead from this passage through the second crankshaft supporting members or webs extending from the cover to the bearings supporting the crankshaft. Preferably, an oil filter is connected to the crankcase cover and positioned along the main gallery for filtering the oil.

A deflector plate is provided in the chamber for deflecting oil which is dispersed through the chamber by the rotating crankshaft. The plate is positioned between the crankcase cover and the crankshaft. In one arrangement, through holes or slots are provided in the cover. Further objects, features, and advantages of the present invention over the prior art will become apparent from the detailed description of the drawings which follows, when considered with the attached figures.

BRIEF DESCRIPTION OF THE DRAWINGS

FIG. 7(*b*) is a front view of the splash-plate illustrated in FIG. 7(*a*);

FIG. 11(*b*) is an exploded side view of the oil pick-up and exhaust guide illustrated in FIG. 11(*a*).

DETAILED DESCRIPTION OF THE PREFERRED EMBODIMENTS OF THE INVENTION

In accordance with the present invention, there is provided an engine 22 having an improved lubricating system in accordance with the present invention. In general, the lubricating system is arranged to simplify the engine's construction to lubricate crankshaft support bearings for a vertically extending crankshaft of the engine, and allow oil which is provided for lubricating the crankshaft and associated support bearings to flow vertically down through a crankcase of the engine for return to an oil reservoir.

Figure 1:
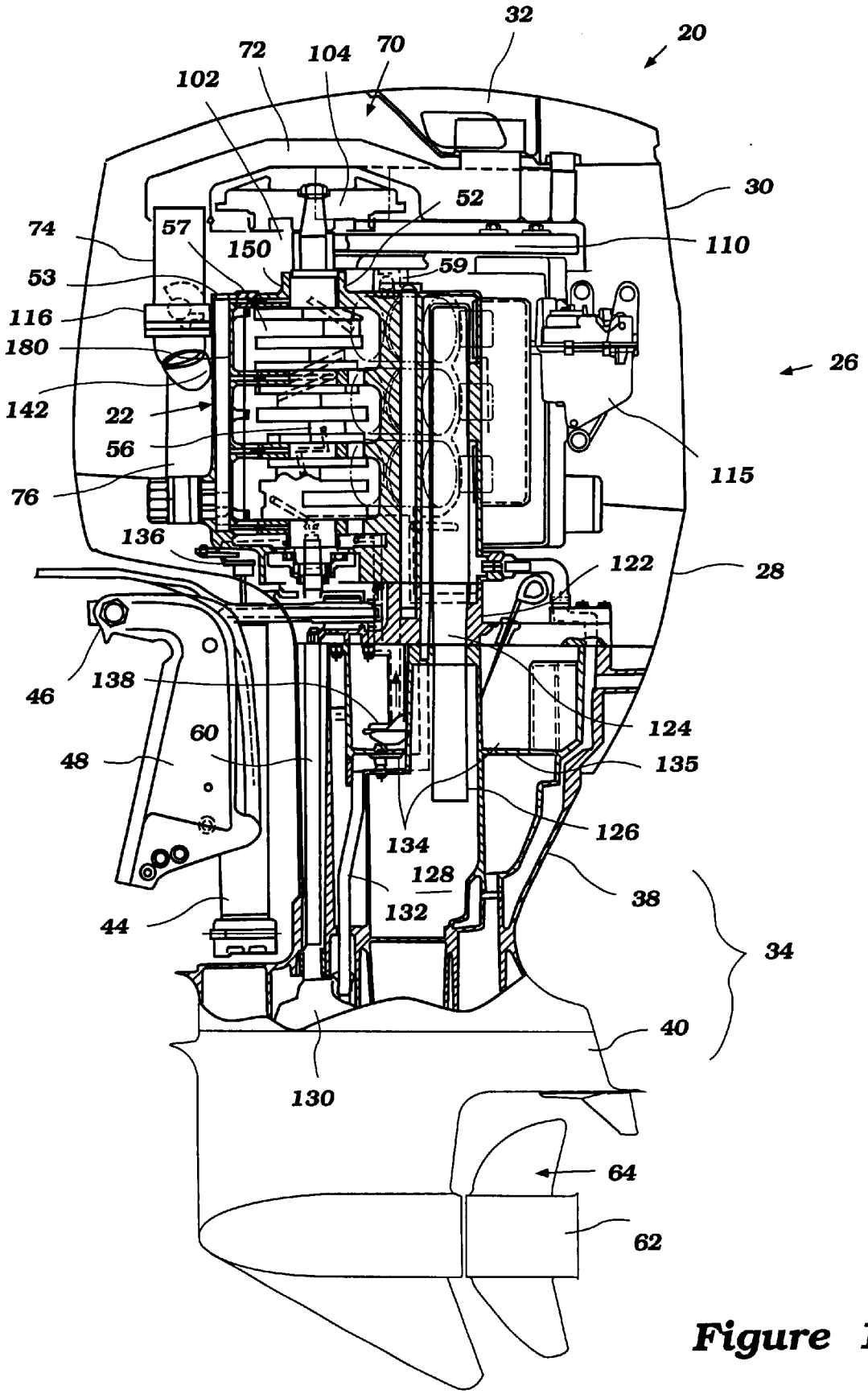
FIG. 1 is a side view of an outboard motor of the type powered by an engine having a lubricating system in accordance with a first embodiment of the present invention.

As illustrated in FIG. 1, the engine 22 having the improved lubricating system of the present invention is may be utilized to power an outboard motor 20 of the type utilized to propel a watercraft (not shown). The outboard motor 20 has a powerhead area 26 comprised of a lower tray portion 28 and a main cowling portion 30. An air inlet or vent area 32 is provided in the main cowling portion 30 for providing air the engine 22 therein. The motor 20 includes a lower unit 34 extending downwardly from the cowling portion 30. The lower unit 34 comprises an upper or "drive shaft housing" section 38 and a lower section 40.

The powerhead area 26 of the motor 20 is connected to a steering shaft (not shown). The steering shaft is supported for steering movement about a vertically extending axis within a swivel or steering bracket 44. The swivel bracket 44 is connected by means of a pivot pin 46 to a clamping bracket 48 which is attached to a transom portion of a hull of the watercraft. The pivot pin 46 permits the outboard motor 20 to be trimmed and tilted up about the horizontally disposed axis formed by the pivot pin 46.

Figure 2:
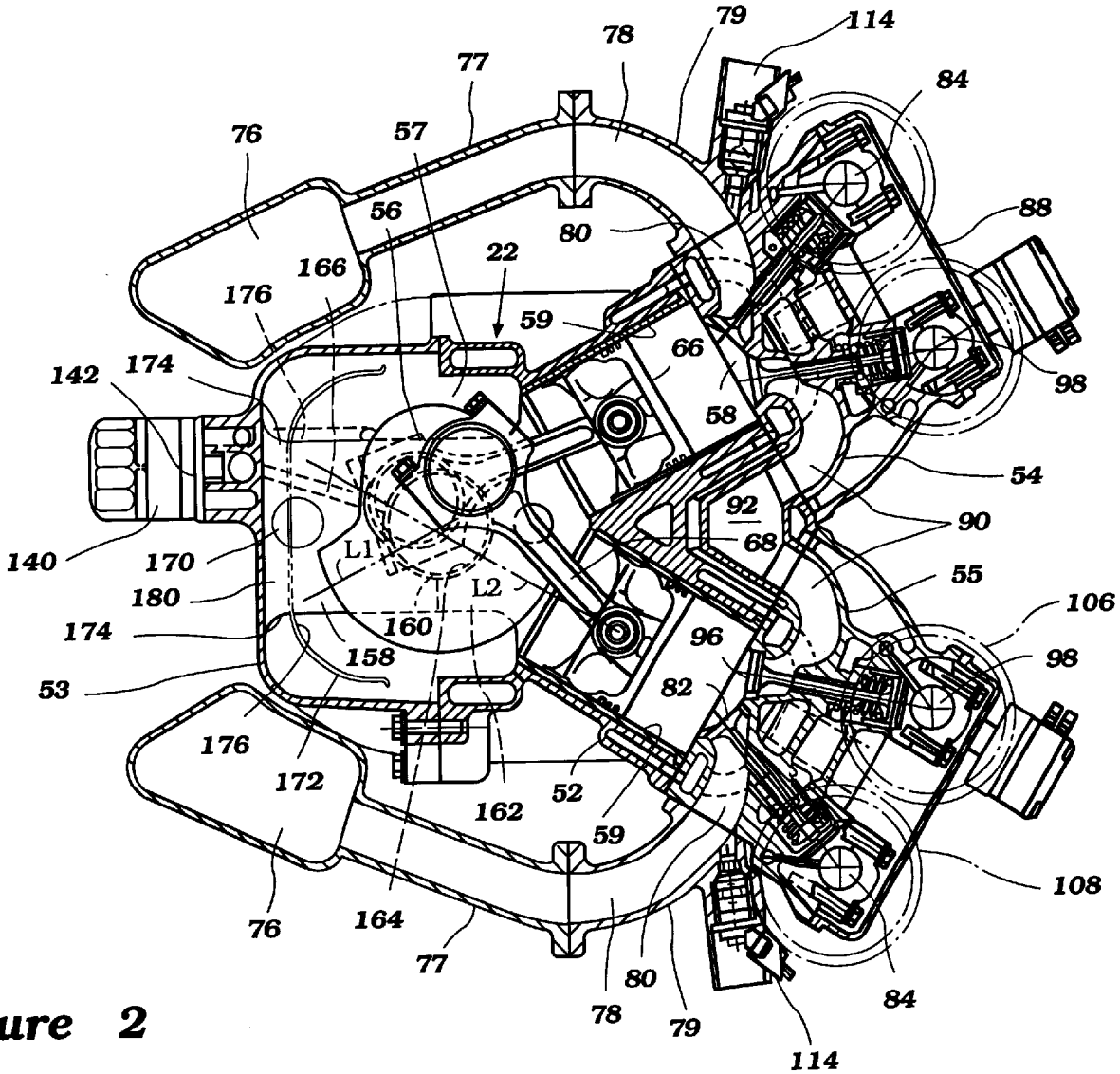
FIG. 2 is a cross-sectional top view of engine powering the motor illustrated in FIG. 1.
Figure 3:
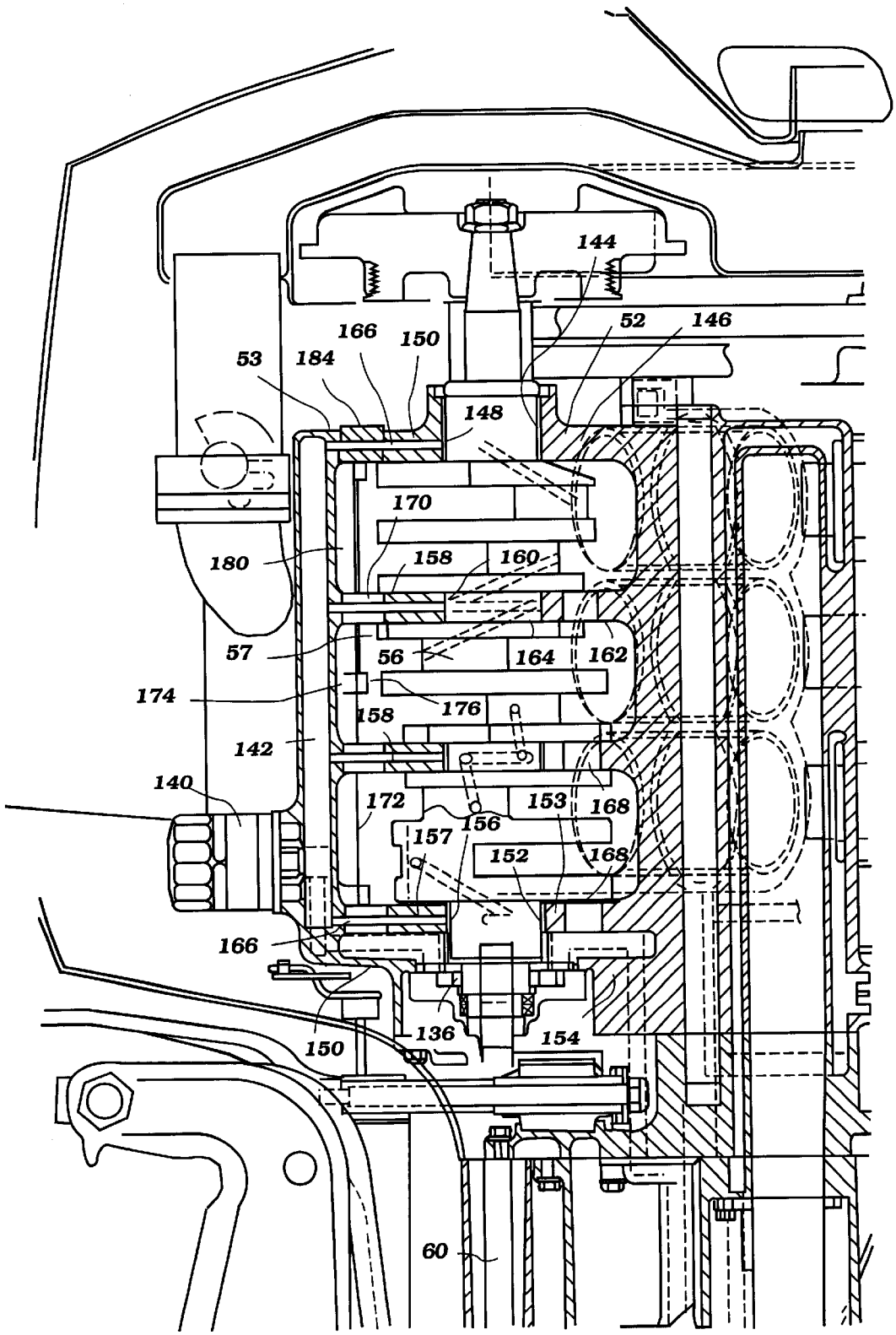
FIG. 3 is a cross-sectional side view of a top portion of the motor illustrated in FIG. 1, illustrating the engine therein in cross-section as well.

Referring to FIGS. 1, 2 and 3, the power head 26 of the outboard motor 20 includes the engine 22 which is positioned within the cowling portion 30. The engine 22 is preferably of the six-cylinder, four-cycle variety, and is arranged in a "V" fashion. In this arrangement, the engine 22 has a cylinder block 52 with a first cylinder head 54 and a second cylinder head 55 connected thereto and cooperating therewith to define first and second cylinder banks. Each bank of cylinders preferably defines three cylinders 59, each having a combustion chamber 58. As may be appreciated by those skilled in the art, the engine 22 may have a greater or lesser number of cylinders, such as two, four, or eight or more. In addition, the engine 22 may have its cylinders arranged in in-line, opposing or other arrangements.

As illustrated in FIG. 2, a piston 66 is movably positioned in each cylinder 59. Each piston 66 is connected to a connecting rod 68 extending to a vertically extending crankshaft 56. Referring to FIG. 3, the crankshaft 56 is arranged to drive a drive shaft 60 which extends downwardly through the lower unit 34, where it drives a bevel gear and a conventional forward-neutral-reverse transmission. The transmission is not illustrated herein, as its construction per se forms no part of the invention. Therefore, any known type of transmission may be employed. A control is preferably provided for allowing an operator to remotely control the transmission from the watercraft 24.

The transmission drives a propeller shaft which is journalled within the lower section 40 of the lower unit 34 in a known manner. A hub 62 of a propeller 64 is coupled to the propeller shaft for providing a propulsive force to the watercraft 24 in a manner well known in this art.

The crankshaft 56 is journalled for rotation with respect to the cylinder block 52. A crankcase cover 53 engages an end of the block 52, defining therewith a crankcase chamber 57 within which the crankshaft rotates. The particular details of the journalled mounting of the crankshaft 56 are provided below. The crankcase cover 53 may be attached to the cylinder block 52 by bolts or similar means for attaching (not shown), as known to those skilled in the art.

The engine 22 includes an air intake system 70 for providing air to each combustion chamber 58. As illustrated in FIGS. 1 and 2, air passes through the vent 32 in the motor cowling 30 and through an air plenum 72 to a main intake pipe 74. As illustrated, this air plenum 72 is formed in a flywheel cover. The main intake pipe 74, in turn, branches to first and second surge tanks 76 having branches 77 extending therefrom. Preferably, each surge tank 76 has a three branches 77 extending therefrom, one for each cylinder 59 in a bank.

Each branch 77 extends to a passage 78 through an intake manifold 79. Each of these passages 78 extends to an intake passage 80 in the cylinder head 54, 55 to one of the combustion chambers 58.

Means are provided for controlling the flow of air into each combustion chamber 58. Preferably, this means comprises at least one intake valve 82 corresponding to each intake passage 80. As illustrated, all of the intake valves 82 for each bank of cylinders are preferably actuated by a single intake camshaft 84. The intake camshaft 84 is mounted for rotation with respect to its respective cylinder head 54, 55 and connected thereto with at least one bracket. Each intake camshafts 84 rotates within an enclosure defined by the cylinder head 54, 55 and a camshaft cover 88 connected thereto.

An exhaust system is provided for routing the products of combustion within the combustion chambers 58 to a point external to the engine 22. In particular, an exhaust passage 90 leads from each combustion chamber to a passage 92 in an exhaust manifold portion of the engine 22. In the arrangement illustrated, this manifold is positioned in the valley between the two banks of cylinders. The remainder of the exhaust system is described in more detail below.

Means are also provided for controlling the flow of exhaust from each combustion chamber 58 to its respective exhaust passage 90. Preferably, this means comprises at least one exhaust valve 96. Like the intake valves 82, the exhaust valves 96 of each cylinder bank are preferably all actuated by a single exhaust camshaft 98. Each exhaust camshaft 98 is journalled for rotation with respect to its respective cylinder head 54, 55 and connected thereto with at least one bracket. Each exhaust camshaft 98 is enclosed within the camshaft cover 88.

As best illustrated in FIG. 1, means are provided for driving the camshafts 84, 98. Preferably, a timing belt pulley 102 is mounted on a top end of the crankshaft 56 positioned outside of the cylinder block 52, and just below a flywheel 104 also positioned on the crankshaft 56. An exhaust camshaft pulley 106 is mounted on an end of each exhaust camshaft 98 extending from the top end of the engine 22, and an intake camshaft pulley 108 is mounted on an end of each intake camshaft 84 extending from the top end of the engine. A drive belt 110 extends around the timing belt pulley 102 and the exhaust and intake camshaft pulleys 106, 108, corresponding to a first cylinder bank, and a second drive belt extends around the timing belt pulley 102 and the exhaust and intake camshaft pulleys 106, 108 of the other cylinder bank. By this arrangement, the camshaft 56 indirectly drives the camshafts 84, 98. One or more tensioner pulleys (not shown) may be provided for maintaining the belt in a taunt condition.

As best illustrated in FIG. 1, an exhaust guide 122 is positioned at the bottom end of the engine 22. The exhaust guide 122 has a passage 124 extending therethrough which is aligned with the exhaust passage 92 in the manifold of the engine 22 at its top side. An exhaust pipe 126 is connected to the bottom side of the exhaust guide 122 in alignment with the passage 124. The exhaust pipe 126 terminates within a chamber of a muffler 128.

The muffler 128 is positioned within the lower unit 34 and between the drive shaft 60 and a cooling liquid return. An exhaust gas outlet is provided in the bottom end of the muffler 128, through which the exhaust gas is routed to a point external of the motor 20.

A fuel delivery system is provided for delivering fuel to each combustion chamber 58 for combustion therein. The fuel delivery system preferably includes a fuel tank (not shown) and a fuel pump (not shown) for pumping fuel from the tank and delivering it to each combustion chamber 58. A vapor separator 115 may be included in the fuel system, and preferably, the fuel is injected into the air stream flowing through each air intake branch 77 with a fuel injector 114.

A throttle 116 is provided for controlling the flow of air into the combustion chambers 58. Preferably, the throttle 116 comprises a moveable plate positioned within air intake pipe 74. The throttle 116 is preferably controlled through a cable by the operator of the watercraft.

A suitable ignition system is provided for igniting an air and fuel mixture within each combustion chamber 58. Such systems are well known to those skilled in the art, and as the ignition system forms no part of the invention herein, such is not described in detail here.

A cooling system is provided for cooling the engine 22. Cooling liquid, preferably in the form of water from the body of water in which the motor 22 is positioned, is pumped by a water pump 130 positioned in the lower unit 34. The pump 130 is preferably driven by the drive shaft 60, and expels the cooling liquid upwardly through a cooling liquid pipe 132. This cooling liquid passes into a number of cooling liquid passages throughout the cylinder block 52 and heads 54, 55. Some of the passages may take the form of jackets which generally surround the respective portions of the cylinders 59, including the combustion chambers 58, formed in the cylinder block 52 and heads 54, 55. Preferably, the coolant path also is arranged to route coolant through one or more passages positioned between the common exhaust passage 92 and the combustion chambers in each bank for cooling the exhaust manifold.

The cooling liquid is preferably routed to a generally vertically extending return passage through the cylinder block 52, for draining the cooling liquid to the bottom of the engine 22. The coolant is then routed through a connecting passage which leads into the lower unit 34 to a cooling liquid pool or chamber extending about the muffler 128 and an oil reservoir 134. When the liquid level in the chamber becomes to high, the cooling liquid runs over an overflow ledge to a passage leading to a drain. The cooling liquid diverted to the drain is discharged from the motor.

A thermostat (not shown) may be provided for selectively controlling the flow of cooling liquid through one or more portions of the engine 22, as known to those skilled in the art. In addition, a pressure relief valve (not shown) may be provided for diverting cooling liquid from the engine in the event the cooling liquid pressure exceeds a predetermined amount.

Preferably, the engine 22 includes a lubricating system for providing lubricant to the various portions of the engine in accordance with the present invention. The lubricating system includes an oil pan 135 defining the oil reservoir 134 positioned below the engine 22. The reservoir 134 is in communication with an oil pump 136 via a suction tube 138. The oil pump is drivingly positioned on the end of the crankshaft 56 at the bottom of the engine 22. The oil pump draws lubricant from the reservoir 134 and then delivers it through an oil filter 140 and on to oil passages through the engine 22, including a main gallery 142.

In accordance with the present invention, the lubricating system is arranged to provide lubricant to those areas within the crankcase 57 where the crankshaft 56 is rotatably supported, and to allow the lubricant supplied into the crankcase chamber 57 to readily drain to the bottom of the crankcase chamber 57 and back to the oil reservoir 134.

Referring to FIG. 3, the crankshaft 56 is rotatably supported at its top and bottom ends. At the top end, a first bearing part 144 is supported by a first crankshaft bearing support in the form of a top wall 146 of the cylinder block 52. A corresponding bearing part 148 is supported by a second crankshaft bearing support in the form of a wall 150 of the crankcase cover 53. These two bearing parts 144,148 cooperate to form a generally circular bearing which extends around a portion of the crankshaft 56 and supports it in rotatable fashion.

A similar second bearing part 152 is supported by a web 153 extending inwardly from the cylinder block 52 adjacent a lower wall 154 of the cylinder block 52. A corresponding bearing part 156 is supported by a web 157 extending from the crankcase cover 53. In this manner, the lower or bottom end of the crankshaft 56 is rotatably supported.

Additional first bearing supports or webs 158 extend from the crankcase cover 53 into the crankcase chamber 57 and support bearing parts 160 thereon between the top and bottom supports. Corresponding second bearing supports or webs 162 extend into the crankcase chamber 57 from the cylinder block 52 and support mating bearing parts 164.

Most importantly, lubricant is supplied to the various bearing parts 144,148,152,156,160, 164. In the preferred arrangement, the oil filter 140 is connected to the crankcase cover 53. The main oil gallery 142 is a passage formed in that portion of the wall of the crankcase cover 53 generally opposite the cylinder block 52. The gallery 142 extends from the bottom end of the crankcase cover 53 (at the oil filter 140) to the top end of the cover.

Figure 4:
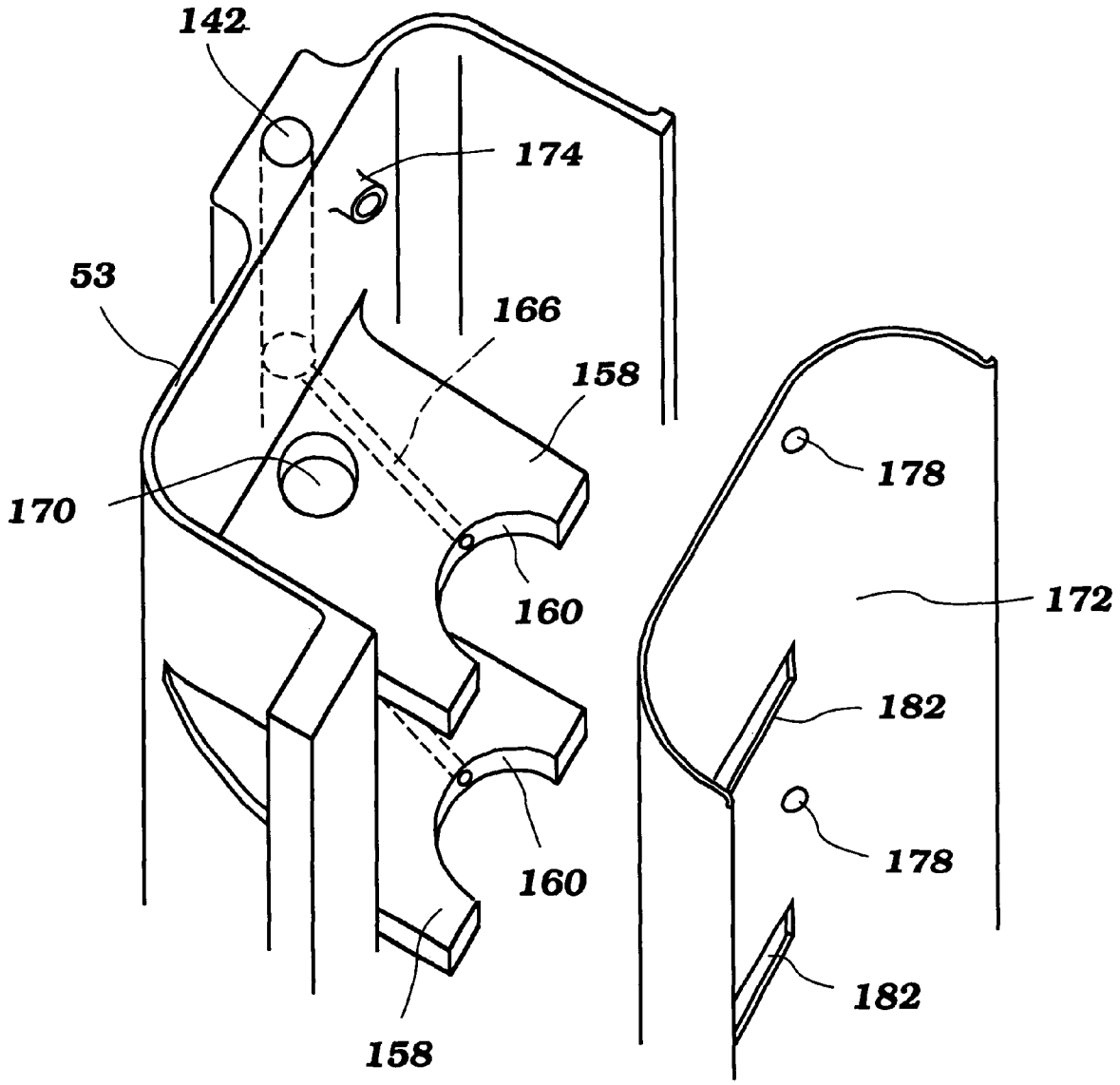
FIG. 4 is an exploded perspective view of a crankcase cover and splash-plate of the engine illustrated in FIGS. 1–3.

As illustrated in FIGS. 3 and 4, individual branch passages or galleries 166 extend from the main gallery 142 through each second crankshaft bearing support. Thus, a branch gallery 166 extends through the wall 150 at the top end of the crankcase cover 53 to the bearing part 148. In addition, similar galleries 166 extend through the webs 157, 158 to the bearing parts 156, 160.

To facilitate the draining of lubricant which is supplied to the bearing parts, through-holes or passages 168 are provided in the webs 153, 162 extending from the cylinder block 52. These through-holes 168 are aligned along a vertical axis and define an oil return path to the lower wall 154 of the cylinder block 52.

Similarly, through-holes or passages 170 are provided through the webs 157, 158 extending from the crankcase cover 53. These passages 157 are also aligned along a vertical axis and form a similar oil return path to the portion of the wall 150 at the bottom of the cover 53.

As illustrated in FIG. 2, these passages 170 are preferably positioned on a crankcase cover 53 side of an intersection point between lines L1 and L2 which extend through the cylinder banks. Likewise, the other passages 168 are positioned between the lines L1 and L2 on the opposite side of their intersection point from the passages 170.

Though not shown, an oil return path or passage is provided from the bottom of the crankcase chamber 57 to the oil reservoir 134.

Preferably, a splash-plate or baffle 172 is provided in the crankcase chamber 57. The splash-plate 172 is connected to the crankcase cover 53. The plate 172 is generally "U"-shaped and extends inwardly towards the crankshaft 56.

A number of bosses 174 extend inwardly from the inside surface of the crankcase cover 53. The splash-plate 172 is mounted to these bosses 174, preferably with bolts 176 extending through a hole 178 in the plate 172 and into the boss 174. So mounted, a space 180 is provided between the plate 172 and cover 53.

The splash-plate 172 is provided with slots 182 for accommodating passage of the webs 158 therethrough. In addition, when mounted in the above-described position, and as best illustrated in FIG. 3, the splash-plate 174 is arranged so that a generally flat base portion thereof generally bisects the passages 170 through the webs 158.

Advantageously, oil which is provided into the crankcase chamber 57 for lubricating the bearing parts which rotatably support the crankshaft 56 freely flows down (with the aid of gravity) to the bottom of the crankcase chamber 53. The lubricating oil is then diverted through an oil return passage to the oil reservoir 134, from which it is recirculated back through the engine 22.

As illustrated in FIG. 3, a passage is provided through the wall 150 of the cover 53 at its top end. A plug 184 is selectively positionable in the passage. A user may remove the plug 184 to add oil to the engine 22 by pouring it through the passage into the crankcase chamber 57, from which it drains into the oil reservoir 134. It is also possible to position a similar passage and plug at the bottom of the crankcase cover 53 for draining oil therefrom.

A second embodiment of the present invention is illustrated in FIGS. 5–8. In the description and illustration of this embodiment, like parts have been given like numerals to those utilized in the description and illustration of the embodiment above, except that an "a" designator has been added thereto.

In general, the motor 20*a* of this embodiment, including the engine 22*a*, is similar to the motor 20 described above, and as such will not be described in detail herein. In this embodiment, the oil pick-up 138*a* comprises a tube extending downwardly from the exhaust guide 122*a*. The tube is aligned with a passage through the exhaust guide 122*a* which leads to the oil pump 136*a*. In this arrangement, a mounting or stay 137*a* is required to support the pick-up 138*a* and connect it to the exhaust guide 122*a*.

First crankshaft bearing supports or webs 162*a* extend from the cylinder block 52*a* and support bearing halves 164*a* which engage portions of the crankshaft 56*a*. A bearing cap 186*a* is connected to the cylinder block 52*a*, preferably with a number of bolts 188*a*. The bearing cap 186*a* has a number of second crankshaft bearing supports or webs 158*a* extending therefrom corresponding to the webs 162*a* extending from the cylinder block 52*a*. Each of these webs 158*a* supports a corresponding bearing part 160*a*. In this manner, the crankshaft 56*a* is rotatably supported in the crankcase chamber 57*a*. A cover 199*a* extends over the top end of the engine 22*a*, cooperating with the cylinder block 52*a* and cover 53*a* to form a contiguous mounting (see FIG. 5).

In this embodiment, lubricant is drawn from an oil reservoir 134*a* by a lubricant pump 136*a*. The pump 136*a* delivers the lubricant through an oil filter 140*a* positioned on a side of the engine 22*a*. The lubricant is then delivered through a main gallery 142*a* extending generally through the valley of the engine 22*a* between the banks of cylinders 59*a*. Individual branch passages or galleries 166*a* extend from the main gallery 142*a* through the webs 162*a* extending from the cylinder block 52*a* to the bearing parts 164*a*.

Like the first embodiment, the lubricating system of the second embodiment preferably includes a splash-plate 174*a*. The splash-plate 174*a* is slightly "U"-shaped, and is connected to the bearing cap 186*a*. Preferably, a number of bolts 190*a* extend through holes 192*a* in the plate 174*a* into the bearing cap 186*a*. So mounted, a space 180*a* is defined between the plate 174*a* and the cover 53*a*. Preferably, one or more bosses 195*a* (see FIG. 6) extend into the chamber 57*a* from the cover 53*a*. These bosses 195*a* extend adjacent the mounting bolts 190*a* and prevent the bolts 190*a* from dislodging, maintaining the plate 174*a* in position.

Figure 7A:
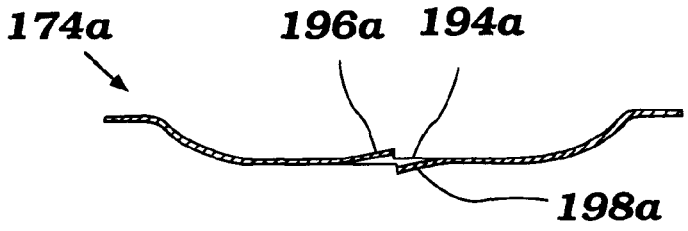
FIG. 7(*a*) is an end view of a splash-plate of the engine illustrated in FIG. 6.
Figure 7B:
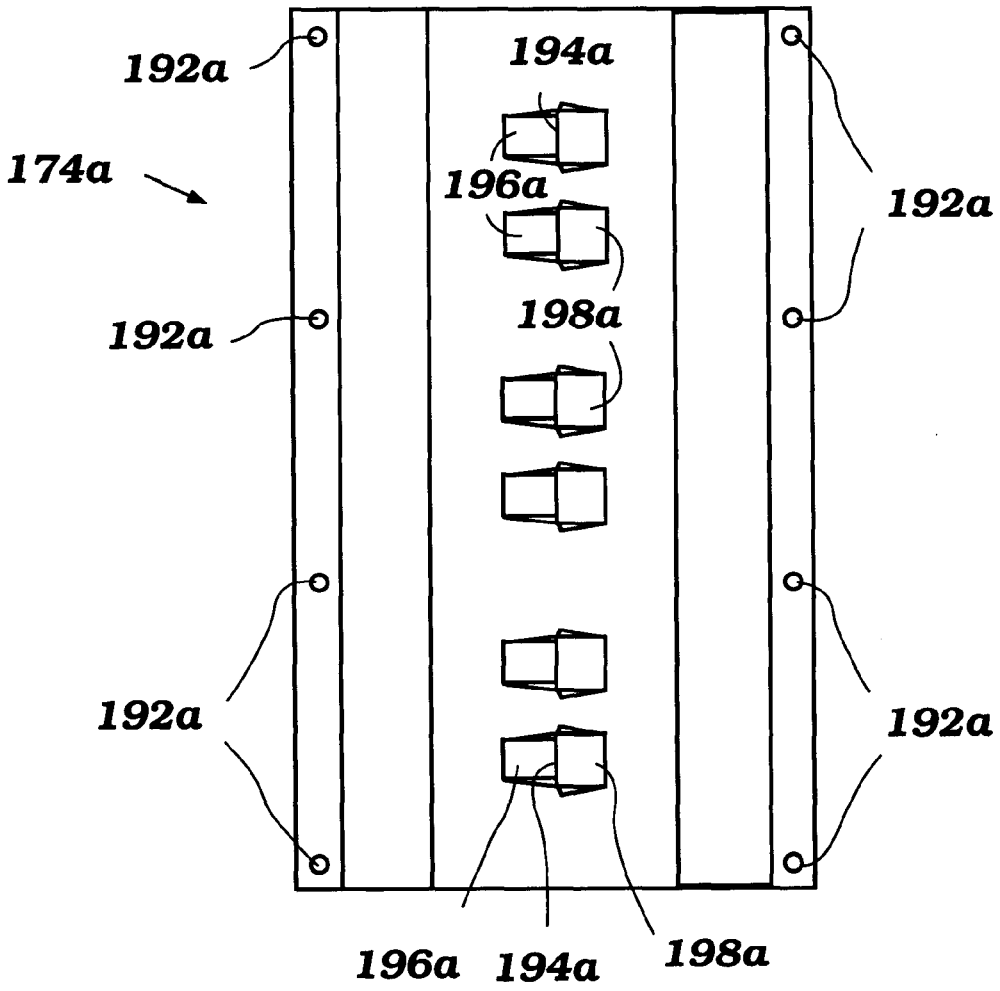

As best illustrated in FIGS. 7(*a*) and 7(*b*), a number of openings 194*a* are formed through the generally flat portion of the plate 174*a*. Each opening 194*a* is formed by a first section 196*a* of the plate which extends outwardly from one side of the plate and an adjacent second section 198*a* which extends outwardly from the opposite side. The sections 196*a* and 198*a* are arranged so that the opening 194*a* is an angled slot extending between the sections 196*a*, 198*a*.

Figure 5:
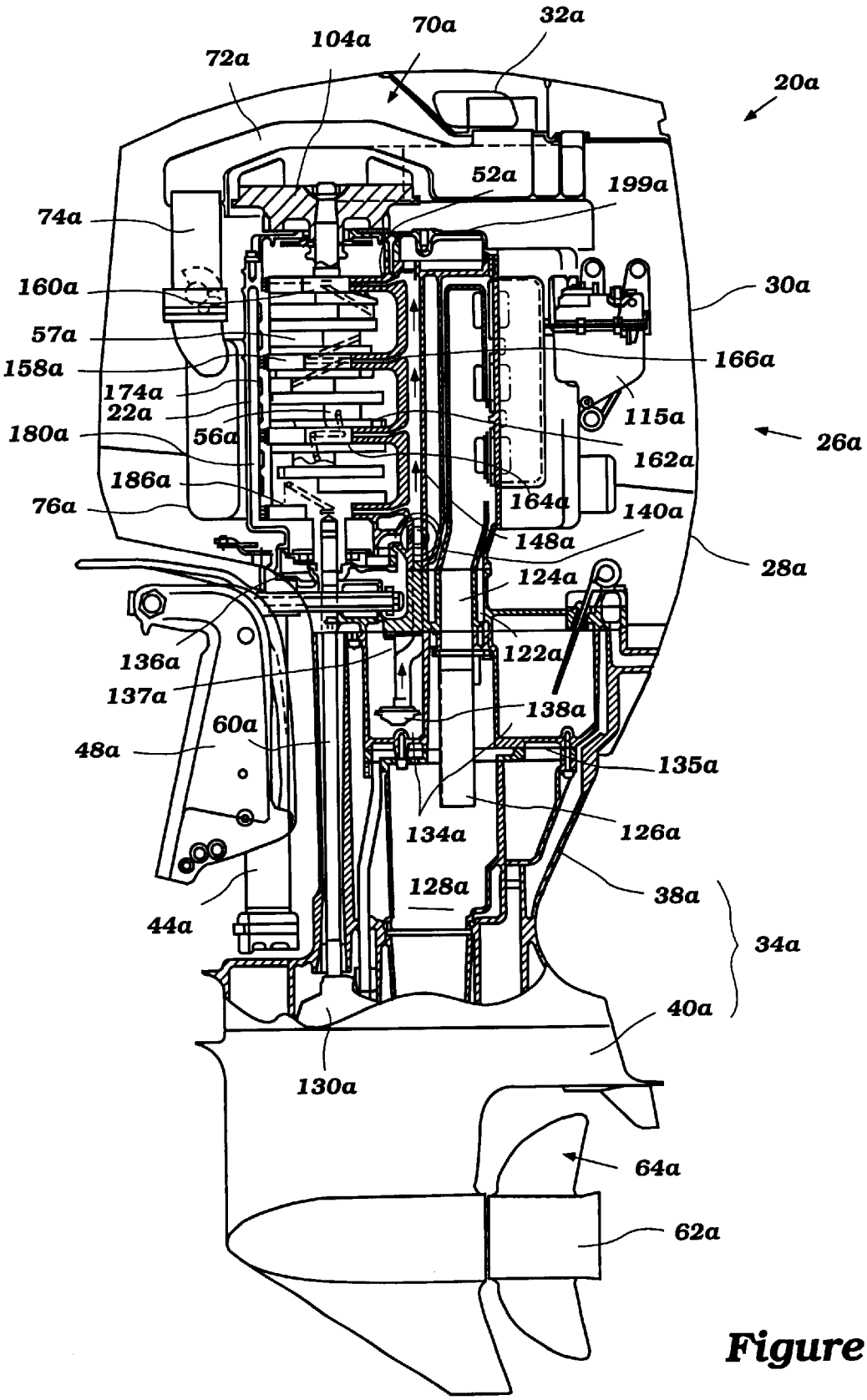
FIG. 5 is a side view of an outboard motor of the type powered by an engine having a lubricating system in accordance with a second embodiment of the present invention.
Figure 6:
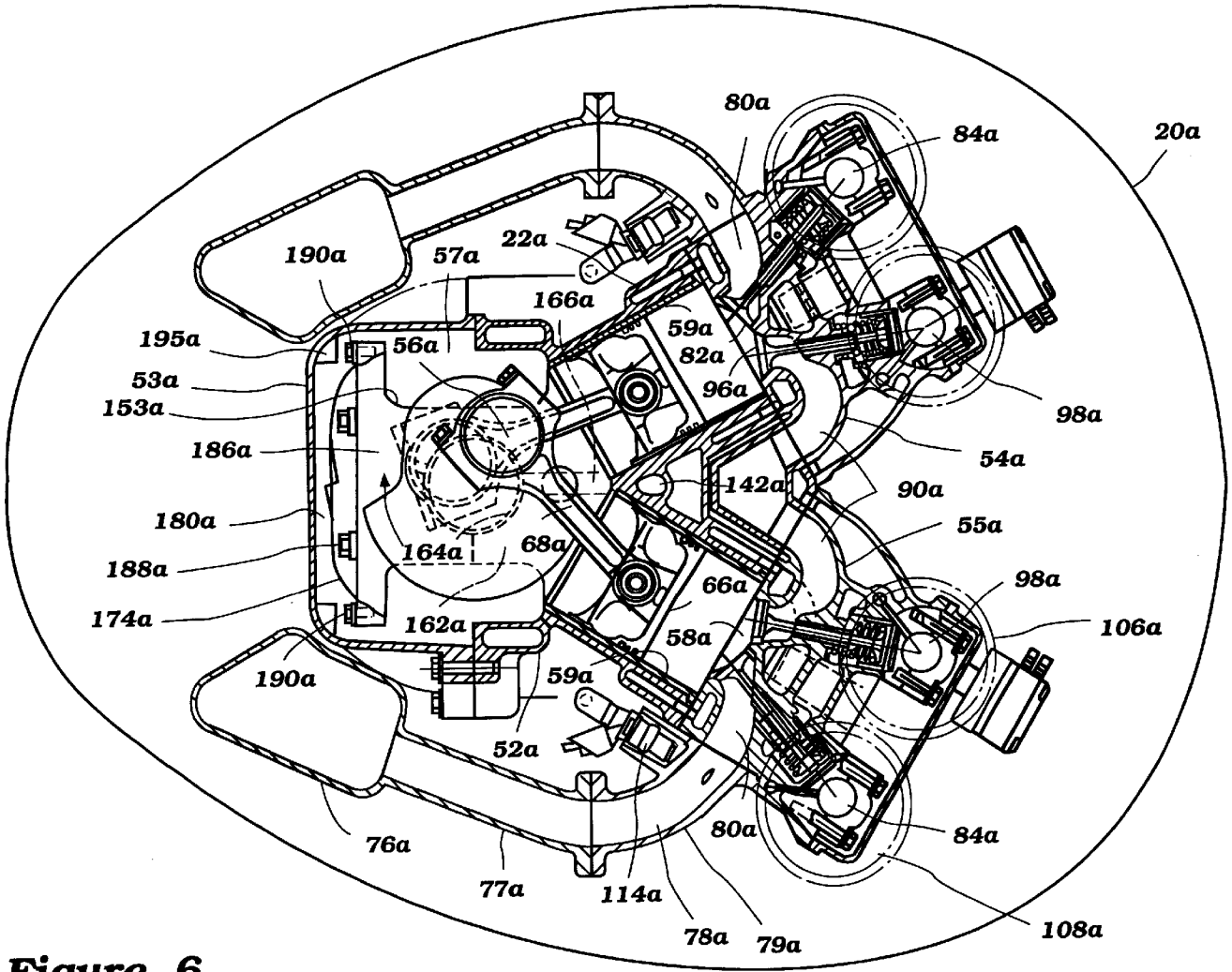
FIG. 6 is a cross-sectional top view of the motor and engine illustrated in FIG. 5.

Preferably, pairs of openings 194*a* are arranged in the plate 174*a* so that when the plate 174*a* is installed, the pairs of openings 194*a* are between crankshaft 56*a* supports, as illustrated in FIG. 5.

Figure 8:
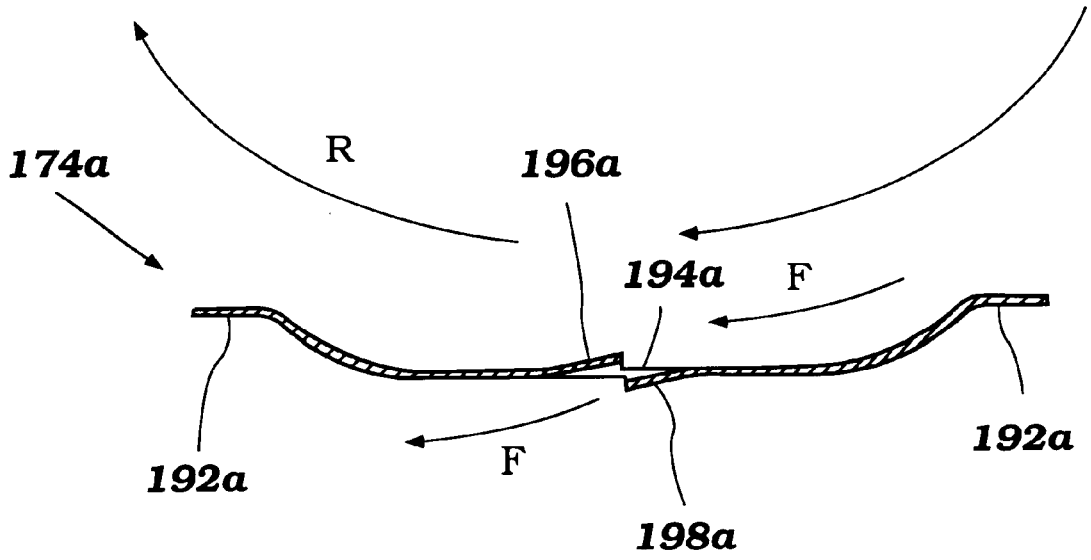
FIG. 8 is an end view of the splash-plate illustrated in relation to a direction of rotation of the crankshaft.

As best illustrated in FIG. 8, the first section 196*a* opens outwardly towards the crankshaft so that the free end of the section 196*a* faces opposite the direction of crankshaft rotation. As illustrated, this arrangement is such that the crankshaft, which is rotating in the direction "R" in FIG. 8, drives air within the chamber and throws lubricant through the chamber in the direction of flow "F." This flow direction "F" is aligned with the opening 194*a*, so that the lubricant and air flows through the plate 174*a* to the backside thereof into the space 180*a* (see FIG. 6). The lubricant then flows down through the crankcase chamber 53*a* to an oil drain, and thereon to the lubricant reservoir 134*a*.

Figure 9:
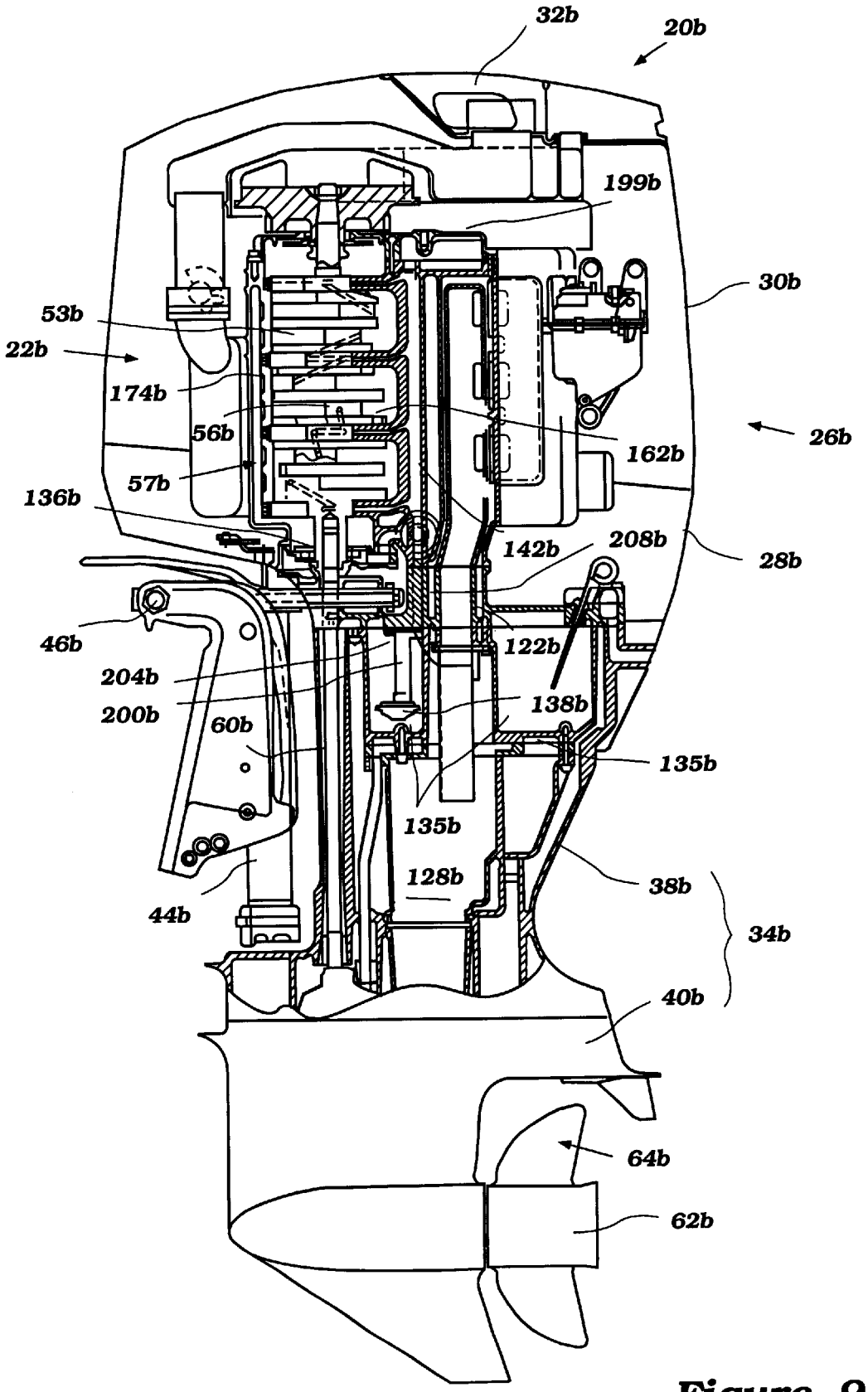
FIG. 9 is a side view of an outboard motor of the type powered by an engine having a lubricating system in accordance with a third embodiment of the present invention.
Figure 10:
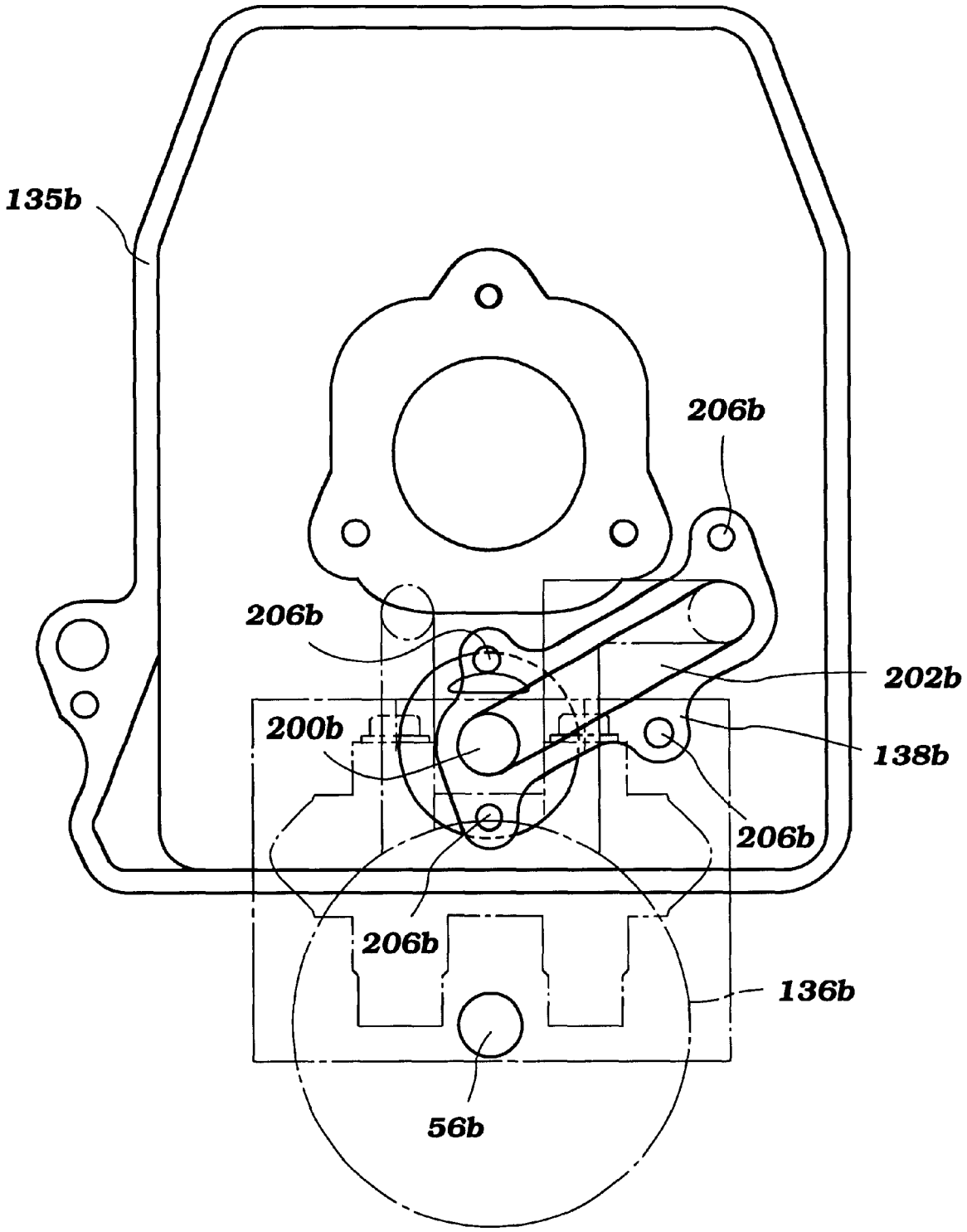
FIG. 10 is a cross-sectional view of an oil pan, oil pick-up and oil pump of the third embodiment lubricating system.
Figure 11A:
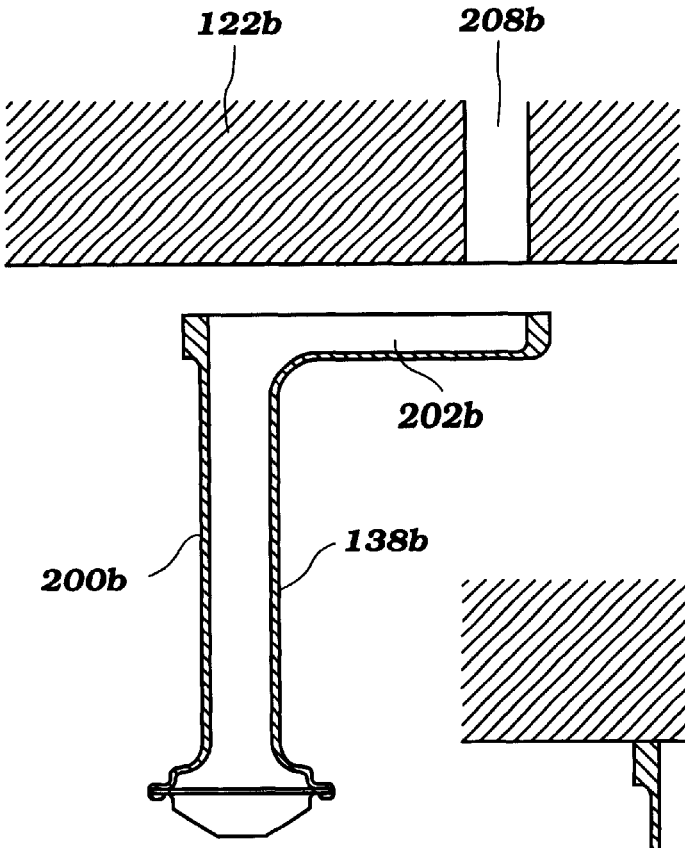
FIG. 11(*a*) is a side view of the oil pick-up connected to an exhaust guide of the engine illustrated in FIG. 9.
Figure 11B:
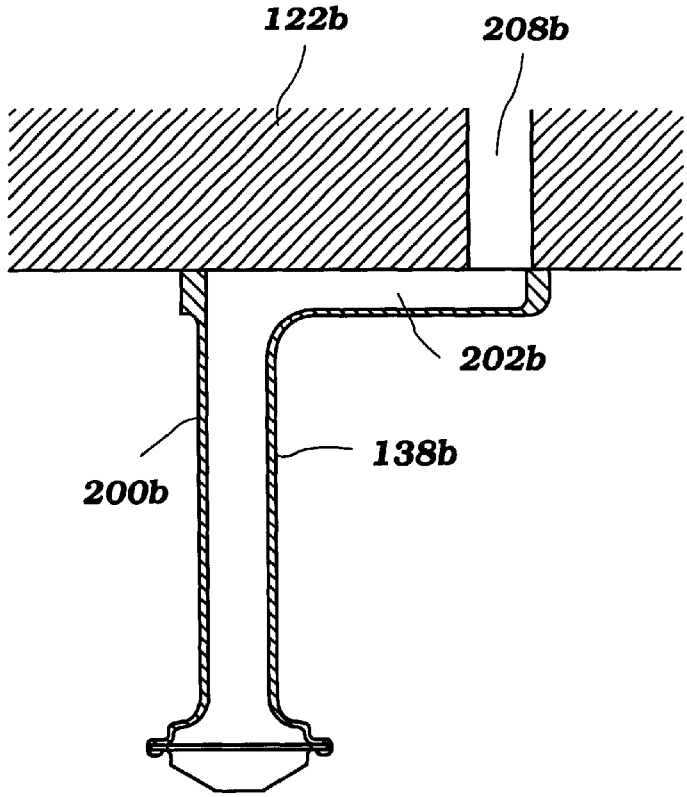

A third embodiment of the present invention is illustrated in FIGS. 9–11. In the description and illustration of this embodiment, like parts have been given like numerals to those utilized in the description and illustration of the embodiments above, except that a "b" designator has been added thereto.

In this embodiment, the motor 20*b*, including the engine 22*b*, are generally similar to those embodiments described above, and as such a detailed recitation thereof is omitted. This embodiment particularly relates to an oil pick-up arrangement for the lubricating system generally illustrated and described in conjunction with the second embodiment described above and illustrated in FIGS. 5–8.

In this third embodiment, the oil pick-up 138*b* comprises a generally vertically extending tube 200*b* leading to a generally horizontal passage 202*b*. The passage 202*b* is formed by a groove in a horizontally extending section of the pick-up 138*b* at the top of the vertical tube 200*b*, cooperating with the exhaust guide 122*b*.

As illustrated, the oil pick-up 138*b* is preferably connected to the exhaust guide 122*b* with a number of bolts 204*b* which extend through mounting holes 206*b* in the horizontal section of the pick-up into the exhaust guide 122*b*.

When the oil pick-up 138*a* is mounted as described above, the horizontal passage 202*b* extends from the passage in the vertical tube 202*b* to a passage 208*b* through the exhaust guide 122*b* which leads to the oil pump 136*b*. Once the lubricant is drawn from the oil reservoir 134*b* by the oil pump 136*b*, the oil is preferably delivered through the engine 22*b* in a manner described above in conjunction with FIGS. 5–8. This oil path preferably includes passages or galleries extending to the bearing parts, an oil flow path through the crankcase chamber 57*b* to the bottom thereof, and an oil return to the oil reservoir 134*b*.

This particular oil pick-up arrangement has advantages in manufacture and assembly. First, the oil pick-up 138*b* is easily cast. Because the horizontal groove cooperates with the bottom of the exhaust guide 122*b* to form the passage 202*b*, the exhaust guide 122*b* does not need to be machined, nor does a complicated "L"-shaped enclosed passage need to be formed in the pick-up. In addition, mounting is easy, with only the necessity of passing the bolts 204*a* through readily accessible holes 206*b* in the pick-up.

Of course, the foregoing description is that of preferred embodiments of the invention, and various changes and modifications may be made without departing from the spirit and scope of the invention, as defined by the appended claims.

What is claimed is:

1. A lubricating system for an internal combustion engine which is arranged such that the crankshaft thereof is vertically oriented, the engine having a cylinder block with a crankshaft cover connected to said cylinder block and cooperating therewith to define a crankshaft chamber in which at least a portion of said crankshaft rotates, said crankcase chamber having a top end and a bottom end and said crankcase cover having a wall portion generally opposite said cylinder block, said cylinder block having at least one first crankshaft supporting member extending therefrom into said chamber, a mating second crankshaft supporting member to said first crankshaft supporting member, said crankshaft having a bearing portion journalled between said first and said second crankshaft supporting members, a lubricating oil source, means for delivering oil from said source to said crankshaft supporting members, a splash-plate positioned between said crankshaft and said crankcase cover, and a lubricating oil return passage extending from said crankcase to said lubricating oil source.

2. The lubricating system in accordance with claim 1, wherein at least one lubricating oil passage is positioned in said wall of said crankcase cover and said oil is delivered from said source to said second crankshaft supporting member through said passage.

3. The lubricating system in accordance with claim 2, wherein a gallery extends from said oil passage in said crankcase cover through said second crankshaft supporting member.

4. The lubricating system in accordance with claim 1, wherein said second crankshaft supporting member extends from said wall of said crankcase cover.

5. The lubricating system in accordance with claim 1, further including an oil filter, said oil filter connected to said crankcase cover.

6. The lubricating system in accordance with claim 5, wherein oil is delivered to said oil filter through a passage in said wall of said crankcase cover.

7. The lubricating system in accordance with claim 1, further including an oil pathway formed through said second crankshaft supporting member.

8. The lubricating system in accordance with claim 7, wherein said splash-plate is generally vertically extending and has a portion aligned with said oil pathway.

9. The lubricating system in accordance with claim 1, wherein a space is formed between said splash-plate and said crankcase cover.

10. The lubricating system in accordance with claim 7, wherein said engine has first and second cylinder banks arranged in a "V"-configuration and a line L1 extending through said first cylinder bank and a line L2 extending through said second cylinder bank intersect at a point in said crankcase chamber, and wherein said oil pathway is positioned between said lines and between said point of intersection and said crankcase cover.

11. The lubricating system in accordance with claim 1, wherein an oil return pathway is formed through said at least one first crankshaft supporting member from a top end to a bottom end of said crankcase.

12. The lubricating system in accordance with claim 1, wherein said second crankshaft supporting member extends from a bearing cap connected to said cylinder block, said bearing cap positioned within said crankcase, and wherein said splash-plate is connected to said bearing cap.

13. The lubricating system in accordance with claim 1, wherein said crankcase cover includes at least one portion extending adjacent said splash-plate for preventing removal of said splash-plate from said bearing cap when said crankcase cover is connected to said cylinder block.

14. The lubricating system in accordance with claim 1, wherein said splash-plate has at least one opening therein.

15. The lubricating system in accordance with claim 14, wherein said opening comprises a slit, said slit angled through said plate in the direction of crankshaft rotation.

16. An internal combustion engine having a vertically oriented crankshaft, the engine having a cylinder block with a crankshaft cover connected to said cylinder block and cooperating therewith to define a crankshaft chamber in which at least a portion of said crankshaft rotates, said crankcase chamber having a top end and a bottom end, said cylinder block having at least one first crankshaft supporting member extending into said chamber, said cover supporting a mating second crankshaft supporting member to said first crankshaft supporting member, said crankshaft having a bearing portion journalled between said first and said second crankshaft supporting members, a lubricant source, a lubricant path through a wall of said crankshaft cover, a passage extending from said path through said second crankshaft supporting member for providing lubricant to said crankshaft bearing portion, and an oil drain flow passage extending vertically through said second crankshaft supporting member for flow of lubricant supplied into said crankcase chamber by gravity generally in the direction from said top end to said bottom end of said chamber to return to said lubricant source.

17. The engine in accordance with claim 16, wherein an oil filter is connected to said crankcase cover and lubricant passes through said path to said oil filter.

18. The engine in accordance with claim 16, further including a splash-plate, said plate positioned between said cover and said crankshaft.

19. The engine in accordance with claim 18, wherein said splash-plate is generally "U"-shaped and has a slot therein corresponding to each second crankshaft supporting member for passage of said second crankshaft supporting members therethrough.

20. The engine system in accordance with claim 16, wherein said engine has first and second cylinder banks arranged in a "V"-configuration and a line L1 extending through said first cylinder bank and a line L2 extending through said second cylinder bank intersect at a point in said crankcase chamber, and wherein said oil drain flow passage is positioned between said lines and between said point of intersection and said crankcase cover.

* * * * *